US008985741B2

(12) United States Patent
Hamada et al.

(10) Patent No.: US 8,985,741 B2
(45) Date of Patent: Mar. 24, 2015

(54) LIQUID EJECTION HEAD

(71) Applicant: Canon Kabushiki Kaisha, Tokyo (JP)

(72) Inventors: Yoshihiro Hamada, Yokohama (JP); Masaki Oikawa, Inagi (JP); Atsushi Omura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/896,486

(22) Filed: May 17, 2013

(65) Prior Publication Data

US 2013/0328968 A1 Dec. 12, 2013

(30) Foreign Application Priority Data

Jun. 7, 2012 (JP) ..... 2012-129892

(51) Int. Cl.
*B41J 2/165* (2006.01)
*B41J 2/14* (2006.01)

(52) U.S. Cl.
CPC *B41J 2/14* (2013.01); *B41J 2/1404* (2013.01); *B41J 2/1433* (2013.01)
USPC ..... 347/47

(58) Field of Classification Search
None
See application file for complete search history.

(56) References Cited

U.S. PATENT DOCUMENTS

| | | | | |
|---|---|---|---|---|
| 6,527,369 | B1 * | 3/2003 | Weber et al. | 347/47 |
| 7,585,616 | B2 | 9/2009 | Shaarawi et al. | |
| 7,735,962 | B2 | 6/2010 | Matsumoto et al. | |
| 7,938,511 | B2 | 5/2011 | Tomizawa et al. | |
| 7,963,635 | B2 | 6/2011 | Oikawa et al. | |
| 8,177,329 | B2 | 5/2012 | Matsumoto et al. | |
| 2010/0053270 | A1 * | 3/2010 | Xu et al. | 347/47 |

* cited by examiner

*Primary Examiner* — Alejandro Valencia
(74) *Attorney, Agent, or Firm* — Fitzpatrick, Cella, Harper & Scinto

(57) ABSTRACT

A liquid ejection head includes ejection ports for ejecting liquid, recesses respectively accommodating the ejection ports in the insides thereof, ejection sections operating as passages directed to the respective ejection ports, and liquid channels for supplying the respective ejection sections with liquid. The ejection sections and the liquid channels are arranged in rows extending in respective directions that intersect each other, and the connection sections respectively connecting the ejection sections and the corresponding liquid channels represent an elliptic contour having a major axis and a minor axis as viewed from the corresponding one of the ejection ports, while the recesses also represent an elliptic contour having a major axis and a minor axis.

7 Claims, 7 Drawing Sheets

LIQUID EJECTION HEAD

BACKGROUND OF THE INVENTION

1. Field of the Invention

The present invention relates to a liquid ejection head to be mounted in a liquid ejection apparatus that ejects liquid such as ink for recording operations.

2. Description of the Related Art

Ejection ports of liquid ejection heads that eject liquid such as ink for high quality image recordings on recording media are required to be downsized to micro dimensions and highly densely arranged. U.S. Pat. No. 7,585,616 discloses a configuration of a liquid ejection head having very small and highly densely arranged ink ejection ports. The disclosed liquid ejection head includes ink ejection ports, liquid channels through which ink is supplied from an ink tank, recesses (lenses) formed on the ink ejection surface of the liquid ejection head and centered at the respective ink ejection ports and ejection sections that respectively link the liquid channels and the corresponding ink ejection ports. Thus, the liquid ejection head includes a plurality of ink ejection ports and each of the ink ejection ports is combined with a liquid channel, a recess and an ejection section that are formed for the ink ejection port.

According to the invention disclosed in the above-cited U.S. Pat. No. 7,585,616, liquid channels are formed in a channel forming member that is bonded to a substrate and ejection sections, each having a tapered profile over the whole circumference thereof, are provided so as to communicate with respective ink ejection ports that are formed on the surface of the liquid ejection head. The substrate and the channel forming member are bonded to each other. More specifically, the channel forming member is bonded to the substrate at the part thereof that is free from liquid channels. The ejection sections are formed with a tapered profile so that ink may be conveyed to the ink ejection ports with little energy. However, as the ejection sections that communicate with the respective ejection ports having a predetermined size are made to represent an entirely tapered profile, any two adjacently located liquid channels are separated from each other inevitably only by a small gap. As the gap separating two adjacently located liquid channels becomes small, the contact area of the substrate and the channel forming member becomes small to give rise to a problem that the adhesion of the channel forming member to the substrate consequently becomes less tight. When the channel forming member is made to adhere to the substrate less tightly, the channel forming member can be lifted from the substrate by the pressure applied to eject ink. Then, the ink flowing through a liquid channel can flow into neighboring liquid channels. As a result, the inks flowing through neighboring liquid channels can be mixed with each other. Additionally, when the channel forming member is peeled off from the substrate under pressure, there arises a situation where ink can no longer be ejected from the liquid ejection head.

Meanwhile, the refill frequency that represents the time period from an ink ejecting operation to the next ink ejecting operation is set to a high level for the purpose of raising the recording speed on a recording medium. As a high refill frequency is set, the number of times of ink ejection per unit time increases. Then, ink needs to be easily ejected from ejection ports. For the purpose of easy ink ejection, each of the ejection sections is made to represent a profile that is tapered toward the corresponding ejection port and hence the cross-sectional area of the ejection section is gradually decreased toward the ejection port. With this arrangement, ink can be ejected with little energy if compared with an arrangement where each of the ejection sections is made to represent a cylindrical profile. However, when the refill frequency is high and the resistance of the liquid channel against ink is small, the meniscus of ink at each of the ejection ports easily vibrates. Then, ink can easily spill out from the ejection port due to vibrations to give rise to a problem that the ink ejection surface of the liquid ejection head is wetted by spilled ink. To avoid this problem, a countermeasure of treating the ink ejection surface of the liquid ejection head is taken to make the surface able to easily absorb spilled ink. However, if ink spills onto the ink ejection surface in a large volume, all the spilled ink cannot be absorbed by the treated ink ejection surface and, consequently, the ink ejection surface of the liquid ejection head becomes wetted. Thus, a countermeasure of providing each ink ejection section with a recess for the purpose of preventing ink from spilling out onto the ink ejection surface of the liquid ejection head is also taken. However, if the capacity of the recesses is small relative to the refill frequency, the recesses cannot accommodate the ink overflowing from the ejection sections and ink can spill out from the recesses to consequently wet the ink ejection surface of the liquid ejection head.

SUMMARY OF THE INVENTION

According to the present invention, there is provided a liquid ejection head including: ejection ports for ejecting liquid; recesses respectively accommodating the ejection ports in the insides thereof; ejection sections operating as passages directed to the respective ejection ports; and liquid channels for supplying the respective ejection sections with liquid, wherein the ejection sections and the liquid channels are arranged in rows extending in respective directions that intersect each other, and the connection sections respectively connecting the ejection sections and the corresponding liquid channels represent an elliptic contour having a major axis and a minor axis as viewed from the corresponding one of the ejection ports, while the recesses also represent an elliptic contour having a major axis and a minor axis.

Further features of the present invention will become apparent from the following description of exemplary embodiments (with reference to the attached drawings).

DESCRIPTION OF THE EMBODIMENTS

Now, an embodiment of the present invention will be described below by referring to the accompanying drawings.

Figure 1:
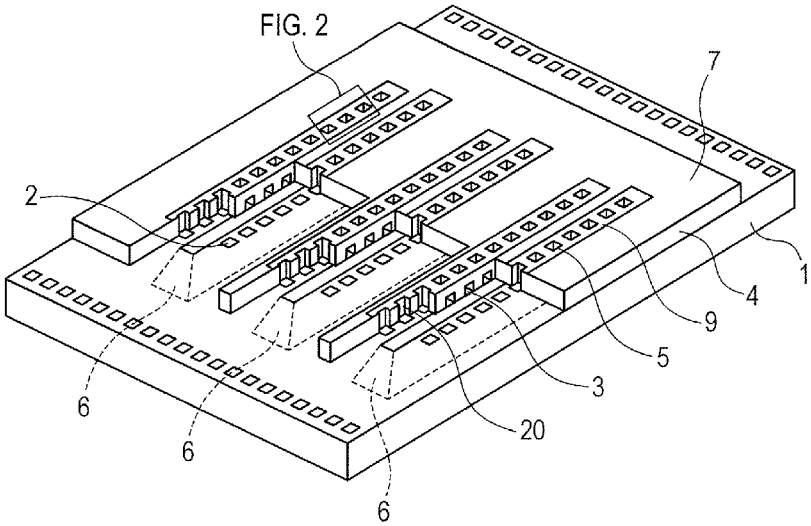
FIG. 1 is a schematic perspective view of an embodiment of liquid ejection head according to the present invention.
Figure 2:
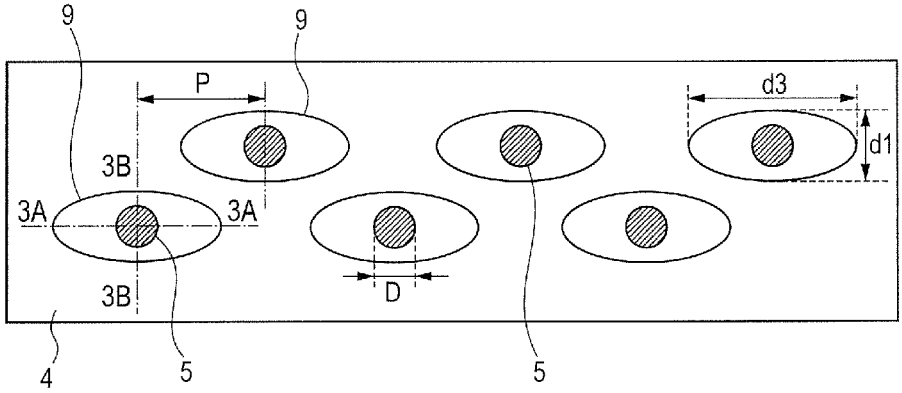
FIG. 2 is an enlarged view of a part of the liquid ejection head illustrated in FIG. 1.

FIG. 1 is a perspective view of an embodiment of liquid ejection head according to the present invention and FIG. 2 is an enlarged view of a part (indicated by "FIG. 2" in FIG. 1) of the liquid ejection head illustrated in FIG. 1.

Liquid ejection apparatus generally include a liquid ejection head having ejection ports for ejecting liquid such as ink. The liquid ejection head of this embodiment mainly includes a substrate 1 and a channel forming member 4. The liquid ejection head also includes ejection ports 5 for ejecting liquid, liquid channels 3 for supplying liquid, ejection sections 20 that operate as so many passages respectively connecting the liquid channels and the corresponding ejection ports and recesses 9 formed to surround the respective ejection ports. Ejection energy generating elements 2 that generate energy necessary for ejecting ink are formed on the substrate 1 and are regularly arranged thereon at a predetermined pitch. The ejection energy generating elements 2 can generate thermal energy as they receive electric energy from the substrate 1. The liquid channels 3 are channels through which ink is supplied from an ink tank (not illustrated) by way of liquid supply ports 6. The liquid channels 3 are formed in the channel forming member 4 and regularly arranged at a predetermined pitch, which is the same as the pitch of arrangement of the ejection energy generating elements 2. The ejection ports 5 for ejecting ink are arranged on ink ejection surface 7 of the channel forming member 4 of the liquid ejection head. The ejection sections 20 communicate respectively with the liquid channels 3. The ejection sections 20 and the liquid channels 3 are arranged in rows and extend in directions that intersect each other (orthogonally intersect each other in this embodiment). Connection sections 20*a* respectively connecting the ejection sections 20 and the liquid channels 3 (see FIGS. 3A and 3B) illustrate an elliptic plan view as viewed from the corresponding respective ejection ports 5 (see FIG. 4A). The ejection sections 20 communicate with the corresponding respective ejection ports 5. Each of the ejection sections 20 is a passage having a cross-section that is tapered so as to provide a cross-sectional area that gradually decreases from the corresponding connection section 20*a* connecting the ejection section 20 with the corresponding liquid channel 3 toward the corresponding ejection port 5. Thus, each of the ejection ports 5 is combined with a liquid channel 3, a recess 9, an ejection section 20 and an ejection energy generating element 2 that are formed for the ejection port. As described above, the ejection ports 5 are formed on the ink ejection surface 7 (ejection ports forming surface) of the channel forming member 4 and the recesses 9 are formed on the ejection port forming surface. The ejection ports 5 are formed in the respective recesses 9.

Figure 4A:
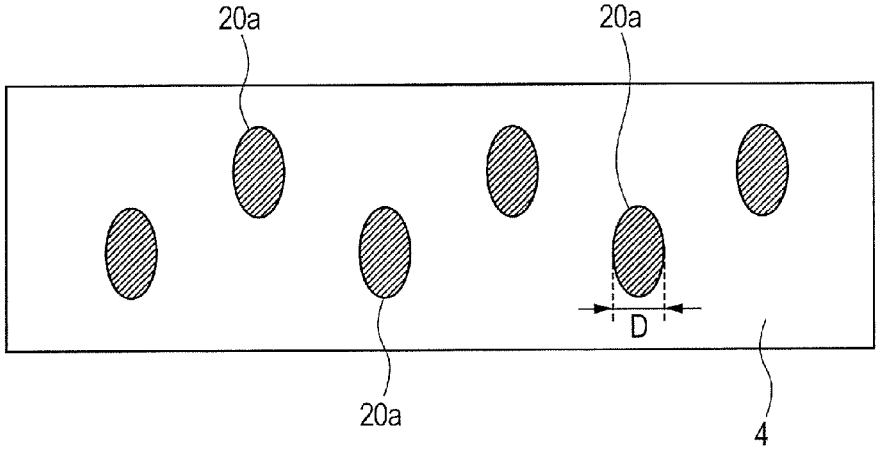
FIG. 4A is a schematic cross-sectional view taken along line 4A-4A in FIG. 3A.
Figure 4B:
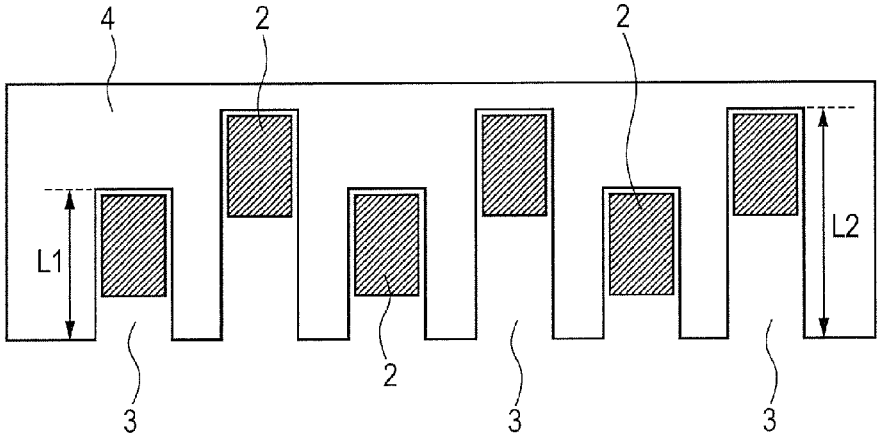
FIG. 4B is a schematic cross-sectional view taken along line 4B-4B in FIG. 3A.
Figure 7A:
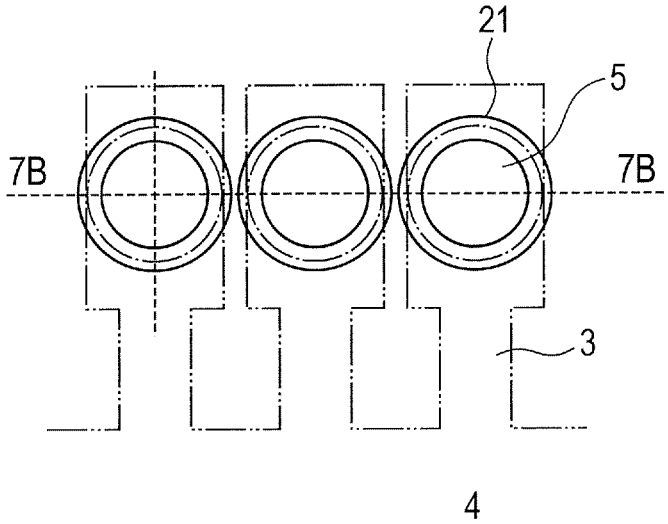
FIG. 7A is a schematic plan view of a part of a known liquid ejection head.
Figure 7B:
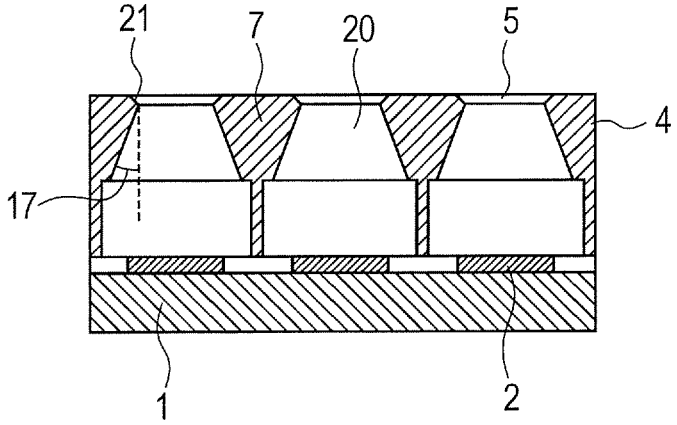
FIG. 7B is a schematic cross-sectional view taken along line 7B-7B in FIG. 7A.

As illustrated in FIG. 4B, the connection sections 20*a* connecting the liquid channels 3 that are formed in the channel forming member 4 and arranged at a predetermined pitch and the corresponding respective ejection sections 20 that are formed in the substrate 1 and arranged at a predetermined pitch, which is the same as the pitch of arrangement of the liquid channels 3, are made to represent an elliptic contour so as to allow any two adjacently located ones of the connection sections 20*a* to be separated from each other by a large gap. The plurality of ejection sections 20 is arranged along a direction that is parallel to the minor axes of the elliptic contours of the connection sections 20*a*. As illustrated in FIGS. 7A and 7B, in contrast, the connection sections of the liquid channels 3 and the ejection sections 20 of any comparable prior art represent a perfectly circular plan view as viewed from the corresponding respective ejection ports 5. Thus, as a result, each of the connection sections is separated from the neighboring one of the connection sections only by a small gap to make the adhesion of the channel forming member 4 to the substrate 1 relatively poor.

On the other hand, the recesses 9 of this embodiment are formed on the ink ejection surface 7 of the liquid ejection head and centered at the respective ejection ports 5 so as to represent an elliptic contour as illustrated in FIG. 2. The major axis of each of the elliptic recesses is greater than the predetermined pitch of arrangement of (the predetermined gaps separating) the ejection energy generating elements 2. Additionally, the recesses 9 are arranged in rows that extend in a direction that runs in parallel with the major axes of the elliptic contours of the recesses 9 and the rows are divided into pairs of rows, the rows of each pair being arranged side by side. The recesses 9 of each pair of rows are directed in the same direction and arranged in a zigzag manner so that any two adjacently located recesses 9 may not interfere with each other. Thus, as the recesses 9 are arranged in a zigzag manner, the ejection energy generating elements 2, the ejection sections 20 and the ejection ports 5 are also arranged in a zigzag manner.

Figure 3A:
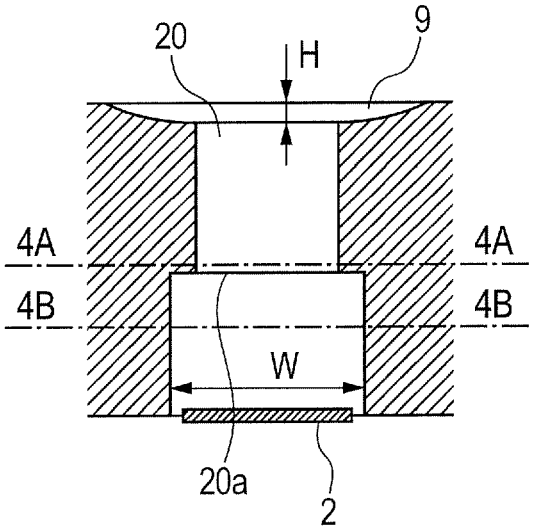
FIG. 3A is a schematic cross-sectional view taken along line 3A-3A in FIG. 2.
Figure 3B:
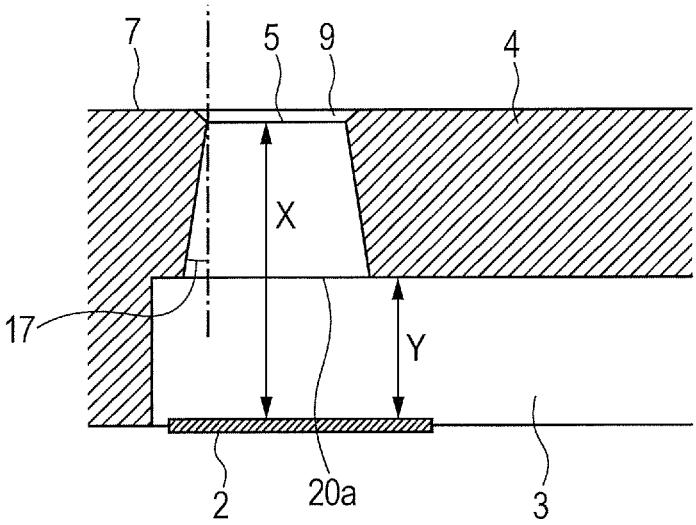
FIG. 3B is a schematic cross-sectional view taken along line 3B-3B in FIG. 2.

As illustrated in FIGS. 3A and 3B, the height X from the substrate to the ejection ports in the thickness direction of the channel forming member is set to be 43 μm and the height Y of the liquid channels from the substrate in the thickness direction of the channel forming member is set to be 20 μm. Additionally, the width W of each of the liquid channels in plan view is set to be equal to 27 μm. As illustrated in FIG. 2, the diameter D of each of the ejection ports is set to be 20 μm and the pitch P of arrangement of the ejection ports in the width direction of the liquid channels is set to be 42 μm (600 dpi) as viewed in plan view. As illustrated in FIG. 4B, liquid channels of two different types having respective lengths of L1=75 μm and L2=105 μm are arranged alternately. As illustrated in FIG. 2, the major axis d3 and the minor axis d1 of each of the recesses 9 are respectively set to be 60 μm and 24 μm in plan view, and the depth H of the recesses 9 in the thickness direction of the channel forming member is set to be equal to 4 μm, while the ink refill frequency is set to be equal to 40 kHz.

In this embodiment, all the recesses 9 and all the connection sections 20*a* of the ejection sections 20 and the liquid channels 3 are made to represent an elliptic contour in plan view but are arranged in respective directions that are orthogonal relative to each other. More specifically, the direction of the major axes d3 of the recesses 9 and the direction of the major axes of the connection sections 20*a* are orthogonal relative to each other. With this arrangement, ink is prevented from spilling out onto the ink ejection surface 7, which will be described hereinafter, and the efficiency of ink ejection energy is improved, while the adhesive force with which the substrate 1 and the channel forming member 4 are bonded to each other is prevented from being reduced.

Now, the method of ejecting ink from a liquid ejection head having the above-described configuration will be described below.

As the ink tank (not illustrated) attached to the ink ejection head receives an electric signal for supplying ink, ink is supplied from the ink tank to the liquid ejection head. More specifically, ink is supplied from the ink supply ports 6 to the liquid channels 3 by way of ink supply routes (not illustrated). As ink is supplied to the liquid channels 3, ink flows into the ejection sections 20 and a liquid surface is produced in each of the ejection ports 5 due to meniscus force as illustrated in FIG. 5B. Then, an electric signal is sent to the ejection energy generating elements 2 by way of the substrate 1 in order to eject ink and the ejection energy generating elements 2 are driven to emit heat. The ink in the liquid channels 3 is forced to generate bubbles by the heat emitted from the ejection energy generating elements 2 and then the ink is ejected from the ejection ports 5.

There has been a growing demand for liquid ejection apparatus that can operate for high quality image recording. To realize high quality image recording, highly viscous ink needs to be employed to improve the adhesion of ink to recording media. A large quantity of energy is required to eject highly viscous ink. The ejection energy generating elements 2 receive a large quantity of energy from the substrate 1 and generate energy necessary for generating a large pressure for ejecting ink. However, as the ejection energy generating elements 2 generate a large quantity of energy in order to bubble ink, the liquid ejection head bears heat to by turn give rise to changes in the ejection characteristics such as a change in the ink ejection rate. For this reason, there is a need of reducing the energy for causing the liquid ejection head to eject highly viscous ink and also the heat that the liquid ejection head bears as much as possible.

For meeting the above-identified need, each of the ejection sections 20 is made to represent a tapered profile with a certain cone angle 17 (see FIGS. 3B and 7B) so as to make its cross-sectional area gradually decrease toward the corresponding ejection port 5. With this arrangement, the resistance against the liquid flowing through the ejection section 20 is reduced if compared with a comparable ejection section representing a cylindrical profile so that ink can be ejected with less energy. The cone angle 17 is preferably not less than 5° because a large cone angle 17 reduces the resistance against the liquid flowing through the ejection section 20. While the cone angle 17 is usually not more than 20°, it can be made to be more than 20° in a situation where an angle more than 20° can be selected for the cone angle 17 because a large space is available on the substrate 1 or for some other reason.

The technological significance of the recesses that are provided according to the present invention will be described below. In prior art liquid ejection heads, no recess is provided on the ink ejection surface of the liquid ejection head and ink ejection ports are provided directly on the ink ejection surface. As ink is ejected from a prior art liquid ejection head having such a configuration, the ink ejected from the liquid ejection head spills out onto the ink ejection surface to consequently obstruct a proper recording operation.

Figure 5A:
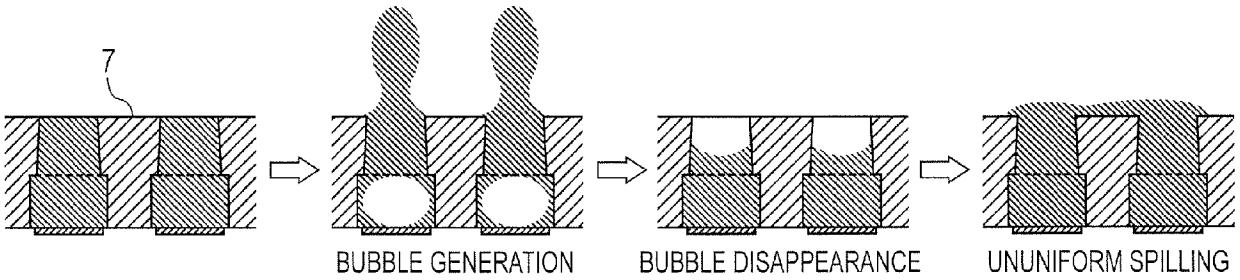
FIG. 5A comprises schematic cross-sectional views of a pair of ejection ports of a known liquid ejection head, illustrating the behavior of ink in the ejection port.
Figure 5B:
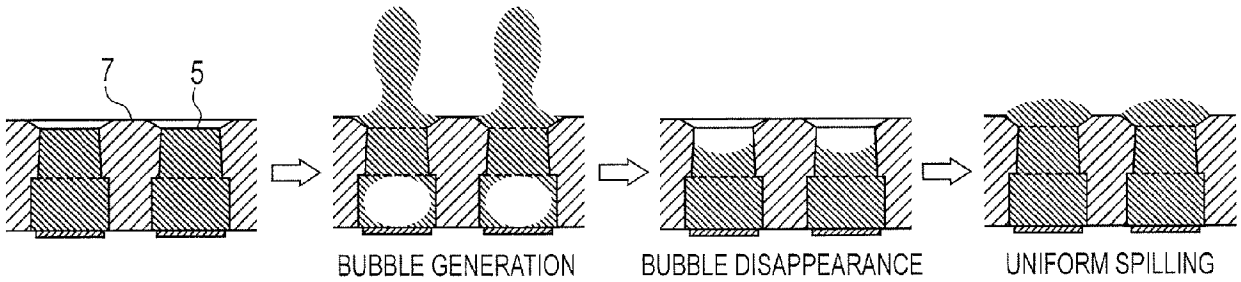
FIG. 5B comprises schematic cross-sectional views of a pair of ejection ports of an embodiment of liquid ejection head according to the present invention, illustrating the behavior of ink in the ejection ports.

As illustrated in FIG. 5A, immediately after ink is ejected from the ejection ports 5, the quantity of ink is reduced by the amount of ink ejected from the ejection sections 20 so that the liquid surface falls from the ejection ports 5 to the insides of the ejection sections 20. Thereafter, the liquid surface is restored to level of the ejection ports 5 by the meniscus force of ink. However, if the refill frequency is raised for high speed recording, there can easily arise an overshooting phenomenon that the ink surface, which is normally below each ejection port 5, rises and rides over the ejection port 5 so that ink can easily spill out onto the ink ejection surface 7 of the liquid ejection head. If such a phenomenon occurs in a liquid ejection head having no recesses at the ejection ports 5, ink immediately spills out onto the ink ejection surface 7 of the liquid ejection head and spreads ununiformly on the ink ejection surface 7 of the liquid ejection head. If the next ink ejecting operation is executed in such a condition, ink is prevented from being properly ejected from the ejection ports by the ink that has ununiformly spread on the ink ejection surface 7 of the liquid ejection head to give rise to a situation where a recording operation cannot be conducted appropriately.

In view of this problem, an arrangement of providing recesses 21 that represent a perfectly circular contour at the respective ejection ports 5 has been established, as illustrated in FIGS. 7A and 7B, so that ink may not immediately spill out onto the ink ejection surface 7 of the liquid ejection head when an overshooting phenomenon occurs. Because of the provision of circular recesses 21, ink does not immediately spill out onto the ink ejection surface 7 even if ink overflows due to overshooting. However, if the recesses only have a small capacity, the ink that has overflowed from the ejection ports due to overshooting can spill out from the recesses soon. The net result will be that ink can easily spill out onto the ink ejection surface 7 of the liquid ejection head. Thus, recesses having a large capacity need to be provided. However, if the recesses are made to have a large capacity such that adjacently located recesses are connected to produce continuously connected recesses and ink overflows due to overshooting, the ink that spills out flows into adjacent recesses that are connected continuously. Then, the spilled ink that is received by a recess and the ink that flows into the recess from an adjacent recess connected to the former recess will be mixed and/or the volume of the ink that is in the recess grows until ink spills out onto the ink ejection surface 7 of the liquid ejection head to give rise to a situation where a recording operation cannot be conducted appropriately.

In view of the above-identified problem, as illustrated in FIG. 2, the liquid ejection head of this embodiment is provided with recesses 9 representing an elliptic contour and the recesses 9 are arranged in rows that extend in a direction that runs in parallel with the major axes of the elliptic contours of the recesses and the rows are divided into pairs of rows, the rows of each pair being arranged side by side. The recesses 9 of each pair of rows are directed in the same direction and arranged in a zigzag manner. With this arrangement, the recesses 9 can be made to have a large capacity and any two adjacently located recesses are not connected or overlapped. Additionally, with this arrangement, a situation where ink spills out onto the ink ejection surface 7 of the liquid ejection head due to overshooting and ink is mixed in some or all of the recesses 9 can be avoided so that any recording operation can be conducted properly on a recording medium.

(Method of Producing Tapered Profile)

Figure 6A:
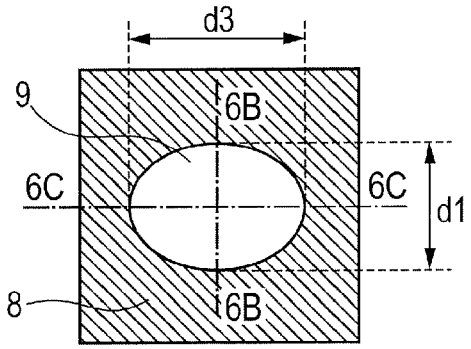
FIG. 6A is a schematic plan view of a part of an embodiment of liquid ejection head according to the present invention, illustrating a step of forming a recess for producing an ejection port thereof.
Figure 6B:
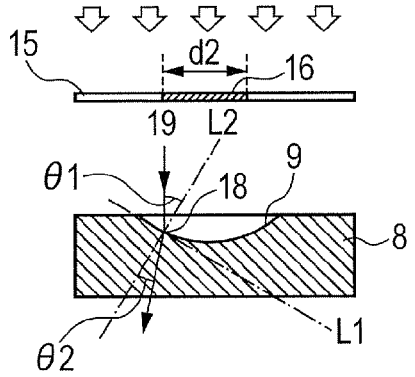
FIG. 6B is a schematic cross-sectional view taken along line 6B-6B in FIG. 6A.
Figure 6C:
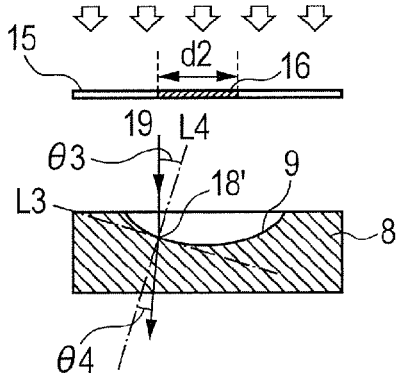
FIG. 6C is a schematic cross-sectional view taken along line 6C-6C in FIG. 6A.

FIGS. 6A through 6C schematically illustrate the method of making the ejection sections 20 to represent a tapered profile by means of a photolithography technique.

Firstly, a mask having a light-shielding portion and a non-light-shielding portion is laid on the surface of a negative-type photosensitive resin layer 8 to cover the surface. The light-shielding portion has an elliptic contour that corresponds to the contour of each of the recesses 9. Since the length of the major axis d3 and that of the minor axis d1 of the elliptic contour of the non-light-shielding portion are factors that determine the cone angle 17 of the tapered profile of each of the ejection sections 20, those lengths need to be determined in advance by way of simulations and calculations. Light is irradiated through the mask onto the surface of the negative-type photosensitive resin layer 8 that is covered by the mask for exposure. After the irradiation of light, the mask is removed from the negative-type photosensitive resin layer 8 and exposed to a development solution (alkali solution). Then, as illustrated in FIG. 6A, a recess 9 having a minor axis d1 and a major axis d3 is formed on the surface of the negative-type photosensitive resin layer 8 so as to correspond to the light-shielding portion of the mask. Since the depth of the recess 9 is controlled by the wavelength of irradiated light and the duration of irradiation of light, both the wavelength of light to be irradiated and the duration of irradiation of light need to be determined in advance by way of simulations and calculations in order to have a predetermined depth.

Then, the surface of the negative-type photosensitive resin layer 8 is covered by a mask 15 having a light-shielding portion 16 with a diameter of d2 for each recess in such a way that the light-shielding portion 16 is laid on the recess 9 on the surface of the negative-type photosensitive resin layer 8. At this time, the minor axis d1 of the recess 9 and the diameter d2 of the light-shielding portion 16 establish a relationship of d1>d2. Light for exposure is irradiated on the negative-type photosensitive resin layer 8 by way of the mask 15 in this condition. As illustrated in FIG. 6B, light 19 that is not blocked by the light-shielding portion 16 is irradiated onto the recess 9 and each of the spots to be irradiated 18 on the minor axis d1 of the recess 9 (and right below the edge of the light-shielding portion 16) is struck by a ray of light, which is then refracted to enter into the inside of the negative-type photosensitive resin layer 8. Assume that the tangent at each of the irradiated spots 18 of the recess 9 is L1 and the perpendicular to the tangent L1 is L2. Then, the angle of incidence of light 19 is angle θ1 formed by the ray of light 19 striking each of the spots to be irradiated 18 and the perpendicular L2. If the angle of refraction formed by the ray of light 19 refracted at each of the irradiated spots 18 and L2 is θ2 and the refractive index at the recess 9 stricken by light 19 is n1, while the refractive index of the negative-type photosensitive resin layer 8 is n2, a relationship of n1 sin θ1=n2 sin θ2 is established due to Snell's law. If light is irradiated onto the negative-type photosensitive resin layer 8 in the atmosphere, the refractive index at the recess 9 is n1=1 and the refractive index θ2 of the negative-type photosensitive layer 8 is greater than 1 so that a relationship of (angle of incidence θ1 of the ray of light 19)>(angle of refraction θ2 of the ray of light 19) holds true. As a result, the ray of light 19 that strikes the negative-type photosensitive resin layer 8 from the recess 9 and by way of each of the irradiated spots 18 expands so as to make the cross-sectional area of the ejection section to be formed there greater than the area of the ejection port 5 formed at the irradiated area 18 as it proceeds into the inside of the negative-type photosensitive resin layer 8. Thus, when the negative-type photosensitive resin layer is developed, an ejection section 20 that represents a tapered profile and whose cross-sectional area decreases from the liquid channel 3 toward the ejection port 5 is produced.

On the other hand, as illustrated in FIG. 6C, light 19 that is not blocked by the light-shielding region 16 is irradiated onto the recess 9 and each of the spots to be irradiated 18' on the major axis d3 of the recess 9 (and right below the edge of the light-shielding portion 16) is struck by a ray of light, which is then refracted to enter into the inside of the negative-type photosensitive resin layer 8. Assume that the tangent at each of the irradiated spots 18' of the recess 9 is L3 and the perpendicular to the tangent L3 is L4. Then, the angle of incidence of light 19 is angle θ3 formed by the ray of light 19 striking each of the spots to be irradiated 18 and the perpendicular L4. Since each of the spots to be irradiated 18' is on the major axis of the recess 9, the curvature thereof is smaller than that of each of the spots to be irradiated 18 that are on the minor axis of the recess 9. Thus, the tangent L3 at each of the spots to be irradiated 18' is less inclined if compared with the tangent L1 at each of the spots to be irradiated 18 and hence the perpendicular L4 at each of the spots to be irradiated 18' is more inclined if compared with the perpendicular L2 at each of the spots to be irradiated 18. Therefore, a relationship of (angle of incidence θ3 of light 19 at each of the spots to be irradiated 18')<(angle of incidence θ1 of light 19 at each of the spots to be irradiated 18) holds true. Additionally, since light 19 strikes those spots on the negative-type photosensitive resin layer 8 in the same condition as the above-described one, a relationship of (angle of refraction θ4 of light 19 at each of the spots to be irradiated 18')<(angle of refraction θ2 of light 19 at each of the spots to be irradiated 18) holds true. As a result, light 19 that strikes the negative-type photosensitive resin layer 8 from the recess 9 and by way of each of the spots to be irradiated 18' expands less than light that strikes by way of each of the spots to be irradiated 18 as it proceeds into the inside of the negative-type photosensitive resin layer 8. Thus, the cone angle 17 of the ejection section 20 formed by the ray of light entering from each of the spots to be irradiated 18' is smaller than the cone angle of the ejection section 20 formed by the ray of light entering from each of the spots to be irradiated 18.

In this way, the cone angle 17 of the ejection section 20 can be made to vary by changing the radius of curvature of the spots to be irradiated by light of the recess 9 from spot to spot so that the ejection section 20 can be made to represent a tapered profile that matches the characteristics of ink to be ejected from the ejection section 20. A large cone angle 17 should be selected when ejecting highly viscous ink, whereas a small cone angle 17 should be selected in order to raise the adhesion between the substrate 1 and the channel forming member 4 when ejecting lowly viscous ink. If the ejection section 20 desirably is not provided with taper, the angle of incidence of light 19 needs to be made equal to 0°. In other words, the area of the recess 9 that is to be irradiated with light needs to be made horizontally flat.

Figure 8:
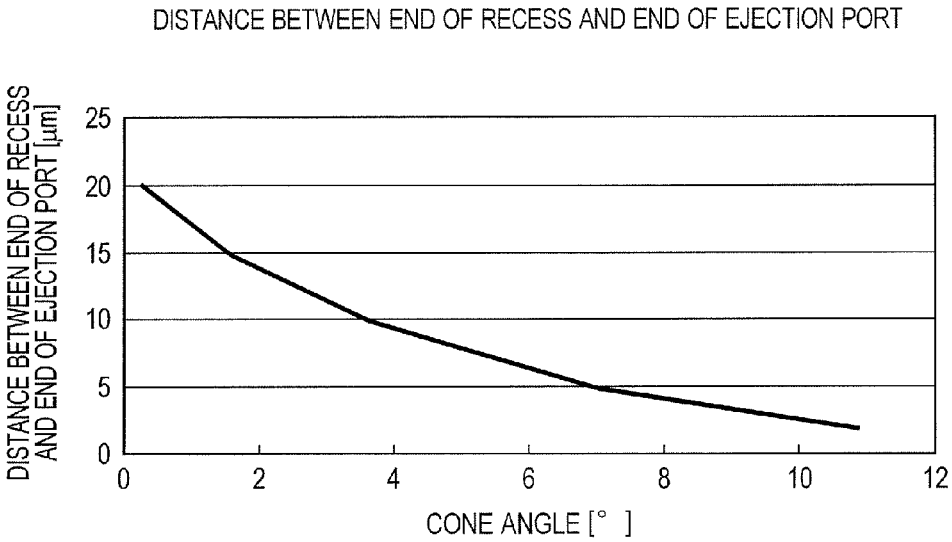
FIG. 8 is a graph illustrating the relationship between the distance from an end of an ejection port to the corresponding end of the recess accommodating the ejection port and the cone angle of the corresponding ejection section.

FIG. 8 is a graph illustrating how the cone angle 17 that is produced in the ejection section 20 changes when the distance from an end of the ejection port 5 having a diameter of 20 μm to the corresponding end of the recess 9 is changed.

In this embodiment, the major axis of the recess 9 is made to be equal to 60 μm and the minor axis of the recess 9 is made to be equal to 24 μm. Thus, the distance from an end of the ejection port 5 on the major axis to the corresponding end of the recess 9 is 20 μm and the distance from an end of the ejection port 5 on the minor axis to the corresponding end of the recess 9 is 2 μm. Then, when these values are applied to the graph of FIG. 8, the cone angle 17 of the ejection section 20 along the major axis is substantially equal to 0° and the cone angle 17 of the ejection section 20 along the minor axis is equal to 11°. This means that the major and minor axes of the elliptic contour of the recesses intersect the major and minor axes of the elliptic contour of the corresponding connection section, respectively, generally in perpendicular to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-129892, filed Jun. 7, 2012, which is hereby incorporated by reference herein in its entirety.

What is claimed is:

1. A liquid ejection head comprising:

ejection ports for ejecting liquid;

recesses respectively accommodating the ejection ports, the ejection ports being respectively accommodated within the recesses;

ejection sections operating as passages directed to the respective ejection ports; and liquid channels for supplying the respective ejection sections with liquid, wherein the ejection sections and the liquid channels are arranged in rows and extend in respective directions that intersect each other, connection sections respectively connect the ejection sections and the corresponding liquid channels and form an elliptic contour having a major axis and a minor axis as viewed from the corresponding one of the ejection ports, while the recesses also form an elliptic contour having a major axis and a minor axis, and the length of the major axis of each of the recesses is greater than a pitch of an arrangement of the ejection ports in a direction parallel to the major axis and the recesses are arranged such that any adjacently located recesses are directed in the same direction.

2. The liquid ejection head according to claim 1, wherein the ejection sections are arranged such that any adjacently located ejection sections are disposed along the direction of the minor axes of the elliptic contours of the connection sections.

3. The liquid ejection head according to claim 1, wherein the length of the minor axis of the elliptic contour of each of the connection sections is the same as the length of the diameter of the corresponding ejection port.

4. The liquid ejection head according to claim 1, wherein the recesses are arranged such that all the recesses are arranged in rows that are divided into pairs of rows, the rows of each pair being arranged side by side, and the recesses of each pair of rows being arranged in a zigzag manner.

5. The liquid ejection head according to claim 1, wherein the direction of the major axes of the elliptic contours of the connection sections and the direction of the major axes of the elliptic contours of the recesses intersect each other.

6. A liquid ejection head comprising:

a surface having ejection ports for ejecting liquid formed thereon;

recesses formed on the surface and having respective ejection ports accommodated within the respective recesses;

ejection sections operating as passages directed to the respective ejection ports; and liquid channels for supplying liquid to the respective ejection sections, the liquid channels extending in a direction intersecting the direction of arrangement of the ejection sections, wherein connection sections respectively connecting the ejection sections and the liquid channels form an elliptic contour having a major axis and a minor axis in plan view as viewed from the ejection ports, the recesses form an elliptic contour having a major axis and a minor axis in plan view, and the length of the major axis of each of the recesses is greater than a pitch of an arrangement of the ejection ports in a direction parallel to the major axis and the recesses are arranged such that any adjacently located recesses are directed in the same direction.

7. The liquid ejection head according to claim 6, wherein the direction of the major axes of the elliptic contours of the connection sections and the direction of the major axes of the elliptic contours of the recesses intersect each other.

* * * * *